US010595704B2

(12) United States Patent
Lee et al.

(10) Patent No.: US 10,595,704 B2
(45) Date of Patent: Mar. 24, 2020

(54) CONTROL METHOD FOR DISHWASHER BY DETECTING RINSING AGENT

(71) Applicant: LG Electronics Inc., Seoul (KR)

(72) Inventors: Sangsoo Lee, Seoul (KR); Myungwon Ko, Seoul (KR); Kitae Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 210 days.

(21) Appl. No.: 15/618,572

(22) Filed: Jun. 9, 2017

(65) Prior Publication Data

US 2017/0354313 A1 Dec. 14, 2017

(30) Foreign Application Priority Data

Jun. 10, 2016 (KR) ..... 10-2016-0072200

(51) Int. Cl.
*A47L 15/42* (2006.01)
*A47L 15/00* (2006.01)
(Continued)

(52) U.S. Cl.
CPC ..... *A47L 15/4287* (2013.01); *A47L 15/0026* (2013.01); *A47L 15/0034* (2013.01);
(Continued)

(58) Field of Classification Search
CPC ..... A47L 15/0034; A47L 15/4244; A47L 15/4287; A47L 15/486; A47L 15/0026; A47L 15/22; A47L 15/4208; A47L 15/4221; A47L 15/4285; A47L 2401/02; A47L 2401/023; A47L 2401/09; A47L 2501/06; A47L 2501/12; A47L 15/0005; A47L 15/0007; A47L 15/0013; A47L 15/0018; A47L 15/0028; A47L 2501/11
See application file for complete search history.

(56) References Cited

U.S. PATENT DOCUMENTS 5,797,409 A * 8/1998 Cooper ..... A47L 15/0031 134/18
2003/0079760 A1 5/2003 Spanyer et al.
(Continued)

FOREIGN PATENT DOCUMENTS

EP 2471432 A2 * 7/2012 ..... A47L 15/0055

OTHER PUBLICATIONS

European Search Report in European Application No. 17174713.2, dated Oct. 18, 2017, 8 pages (with English translation).

*Primary Examiner* — Douglas Lee
(74) *Attorney, Agent, or Firm* — Fish & Richardson P.C.

(57) ABSTRACT

A method of controlling a dishwasher includes washing an object accommodated inside a tub by spraying water and detergent onto the object, rinsing the object by spraying water onto the object, drying the object by removing moisture adhered to the object, detecting an amount of a rinsing agent, comparing the detected amount of the rinsing agent to a predetermined amount, based on the comparison, determining whether the detected amount of the rinsing agent is less than the predetermined amount, and increasing at least one of a temperature of water to be supplied in the rinsing or a drying time in the drying based on determining that the detected amount of the rinsing agent is less than the predetermined amount.

20 Claims, 11 Drawing Sheets

(51) Int. Cl.

| | |
|---|---|
| ***A47L 15/48*** | (2006.01) |
| *A47L 15/24* | (2006.01) |
| *A47L 15/22* | (2006.01) |

(52) U.S. Cl.

CPC ..... *A47L 15/4208* (2013.01); *A47L 15/0005* (2013.01); *A47L 15/0013* (2013.01); *A47L 15/22* (2013.01); *A47L 15/245* (2013.01); *A47L 15/4221* (2013.01); *A47L 15/4244* (2013.01); *A47L 15/4285* (2013.01); *A47L 15/486* (2013.01); *A47L 2401/02* (2013.01); *A47L 2401/023* (2013.01); *A47L 2401/09* (2013.01); *A47L 2501/06* (2013.01); *A47L 2501/11* (2013.01); *A47L 2501/12* (2013.01)

(56) References Cited

U.S. PATENT DOCUMENTS

| | | | | |
|---|---|---|---|---|
| 2005/0133064 | A1* | 6/2005 | Rosenbauer ..... | A47L 15/0026 134/18 |
| 2009/0159099 | A1* | 6/2009 | Fauth ..... | A47L 15/4225 134/18 |
| 2014/0150286 | A1* | 6/2014 | Jadhav ..... | A47L 15/0034 34/443 |

* cited by examiner

CONTROL METHOD FOR DISHWASHER BY DETECTING RINSING AGENT

This application claims the benefit of Korean Patent Application No. 10-2016-0072200, filed on Jun. 10, 2016, which is hereby incorporated by reference as if fully set forth herein.

BACKGROUND OF THE INVENTION

Field of the Invention

The present invention relates to a control method for a dishwasher.

Discussion of the Related Art

A dishwasher is an appliance that removes contaminants such as, for example, food residue, attached to, for example, dishes or cookware (hereinafter referred to as "washing objects") using a detergent and wash water.

Such a dishwasher generally performs a washing process of spraying water and detergent on the washing object, a rinsing process of removing remaining contaminants and detergent by spraying water on the washing object, and a drying process of removing moisture from the surface of the washing object.

Meanwhile, a rinsing agent may be used in order to reduce the time consumed for the drying operation. The rinsing agent may be sprayed, along with water, during the rinsing operation, and may reduce the time taken for the washing object to dry by weakening the surface tension of water.

However, conventional dishwashers have been configured to perform the same operation under a selected course regardless of whether the rinsing agent is present. Therefore, a shortage of the rinsing agent may cause the washing object to be incompletely dried.

SUMMARY OF THE INVENTION

Accordingly, the present invention is directed to a control method for a dishwasher that substantially obviates one or more problems due to limitations and disadvantages of the related art.

An object of the present invention is to provide a control method for a dishwasher, which enables a washing object to be completely dried regardless of whether a rinsing agent is present.

Additional advantages, objects, and features will be set forth in part in the description which follows and in part will become apparent to those having ordinary skill in the art upon examination of the following or may be learned from practice. The objectives and other advantages may be realized and attained by the structure particularly pointed out in the written description and claims hereof as well as the appended drawings.

To achieve these objects and other advantages and in accordance with the purpose of the invention, as embodied and broadly described herein, in accordance with an aspect of the present invention, a method of controlling a dishwasher includes washing a washing object accommodated inside a tub by spraying water and a detergent onto the washing object, rinsing the washing object by spraying water onto the washing object, drying the washing object by removing moisture adhered to the washing object, detecting an amount of a rinsing agent, and increasing at least one of a temperature of the water to be supplied in the rinsing or a drying time in the drying when the detected amount of the rinsing agent is less than a predetermined amount.

In exemplary embodiments, the detecting the amount of the rinsing agent may be performed before the washing.

In exemplary embodiments, the rinsing may include heating-rinsing the washing object by spraying water, heated to a predetermined temperature, onto the washing object, and the increasing the temperature of the water to be supplied may include increasing the predetermined temperature in the heating-rinsing.

In exemplary embodiments, the drying may include operating a drying fan so as to discharge air inside the tub to an outside, and the increasing the drying time may include increasing an operating time of the drying fan.

In exemplary embodiments, the increasing the operating time of the drying fan may include increasing an interval between an on-time and an off-time of the drying fan.

In exemplary embodiments, the rinsing may include spraying the rinsing agent onto the washing object when the detected amount of the rinsing agent is the predetermined amount or more.

In another aspect of the present invention, a method of controlling a dishwasher, includes receiving information about a washing course including at least one process among a washing process, a rinsing process, and a drying process, loading an operating condition for each process with respect to the received washing course, detecting an amount of a rinsing agent, and automatically resetting the loaded operating condition when the detected amount of the rinsing agent is less than a predetermined amount.

In exemplary embodiments, the operating condition may include a temperature of water to be supplied in the rinsing process and a drying time during which the drying process proceeds.

In exemplary embodiments, the automatically resetting may include increasing the temperature of the water to be supplied in the rinsing process.

In exemplary embodiments, the automatically resetting may include increasing an operating time of a drying fan in the drying process.

According to exemplary embodiments of the present invention, a control method for a dish washer may automatically reset operating conditions for each process according to the amount of rinsing agent. Thereby, the complete drying of a washing object may be realized even when the rinsing agent is not used.

The effects of the present invention are not limited to the effects as mentioned above, and other unmentioned objects will be clearly understood by those skilled in the art from the following claims.

It is to be understood that both the foregoing general description and the following detailed description of the present invention are exemplary and explanatory and are intended to provide further explanation of the present invention as claimed.

BRIEF DESCRIPTION OF THE DRAWINGS

The accompanying drawings, which are included to provide a further understanding of the present invention and are incorporated in and constitute a part of this application, illustrate embodiment(s) of the present invention and together with the description serve to explain the principle of the present invention. In the drawings.

DETAILED DESCRIPTION OF THE INVENTION

Figure 1:
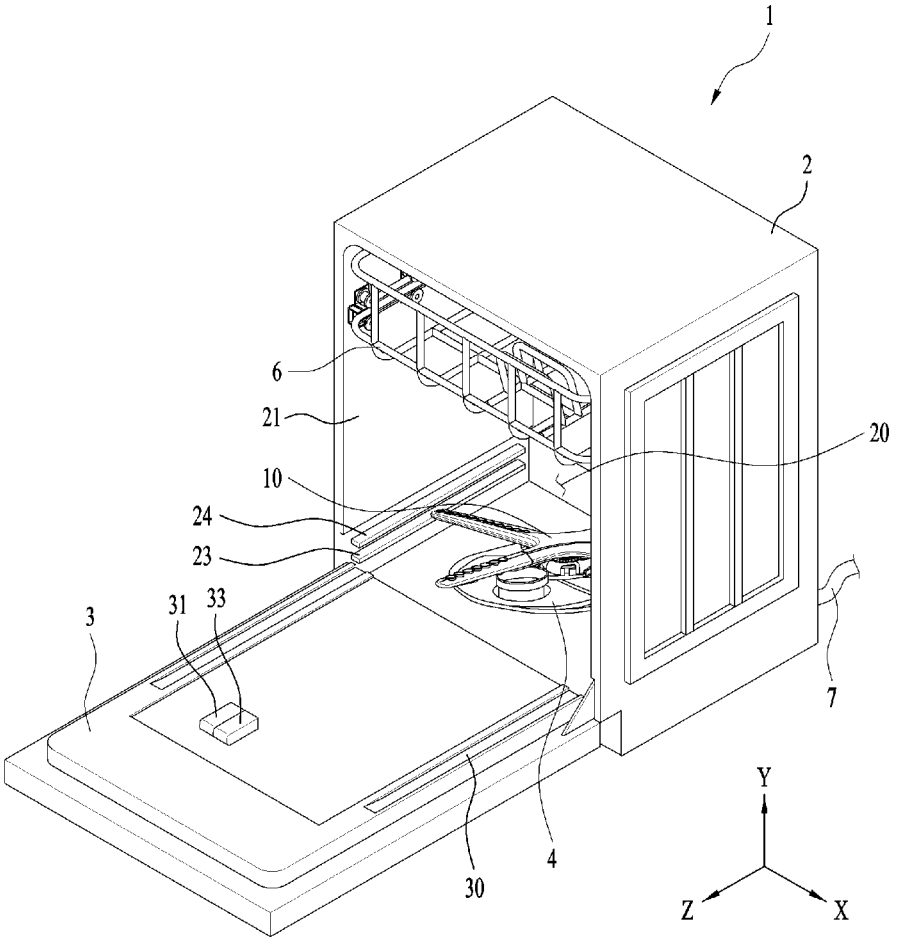
FIG. 1 is a perspective view illustrating a dishwasher.

Hereinafter, exemplary embodiments of the present invention will be described in more detail with reference to the accompanying drawings. Meanwhile, descriptions related to specific structures and functions are merely given in order to describe the embodiments of the present invention, but are not intended to limit the present invention to the disclosed specific forms, and should be understood to include all modifications, equivalents, and substitutions, which are included in the spirit and scope of the present invention. In addition, the same reference numerals are given to the same constituent elements in the drawings, and a repeated description of the same constituent elements will be omitted.

Figure 2:
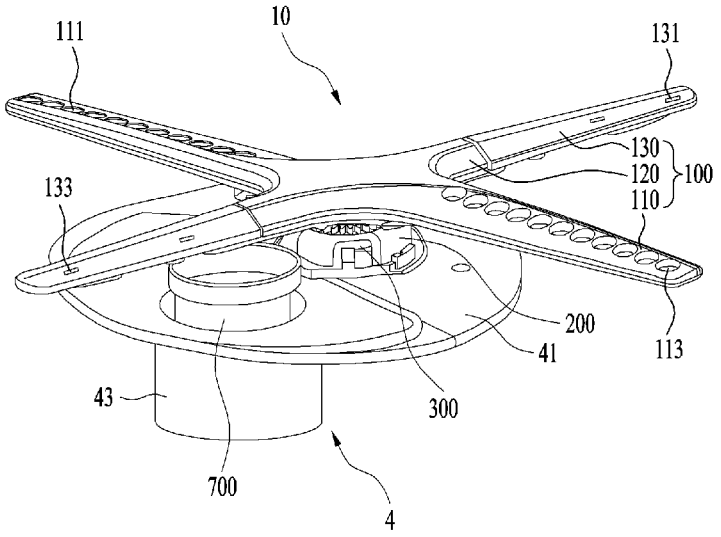
FIG. 2 is a perspective view illustrating a sump and a spray arm assembly of FIG. 1.
Figure 3:
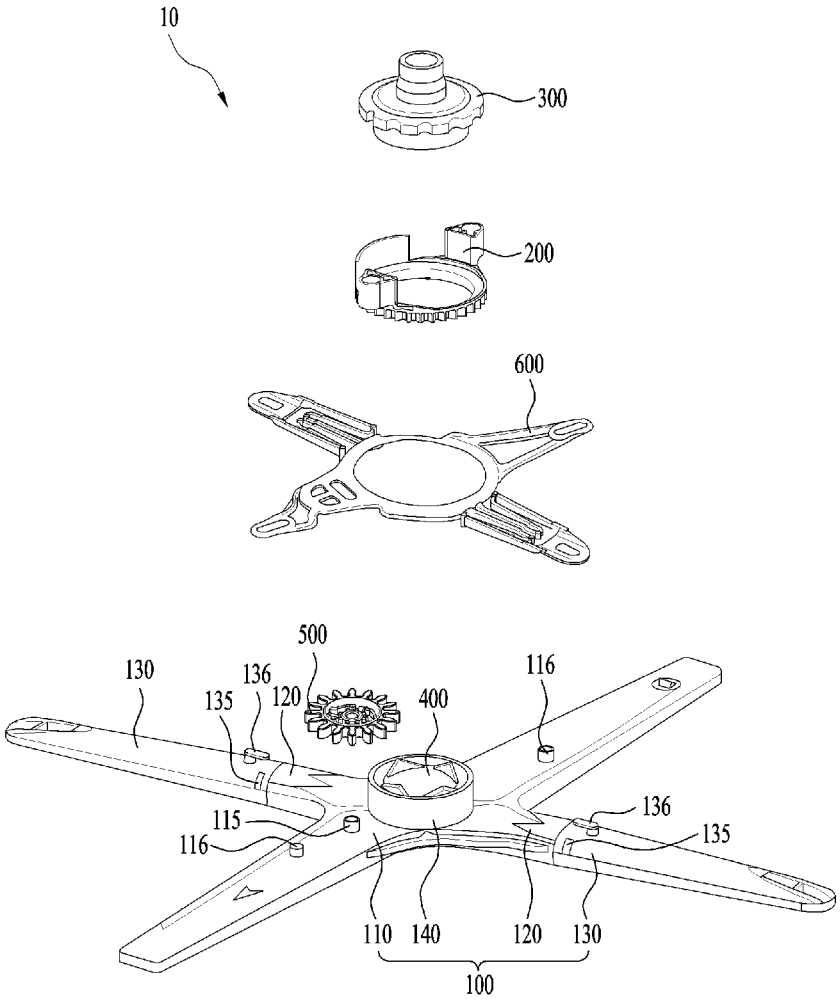
FIG. 3 is an exploded perspective view illustrating the spray arm assembly of FIG. 2.
Figure 4:
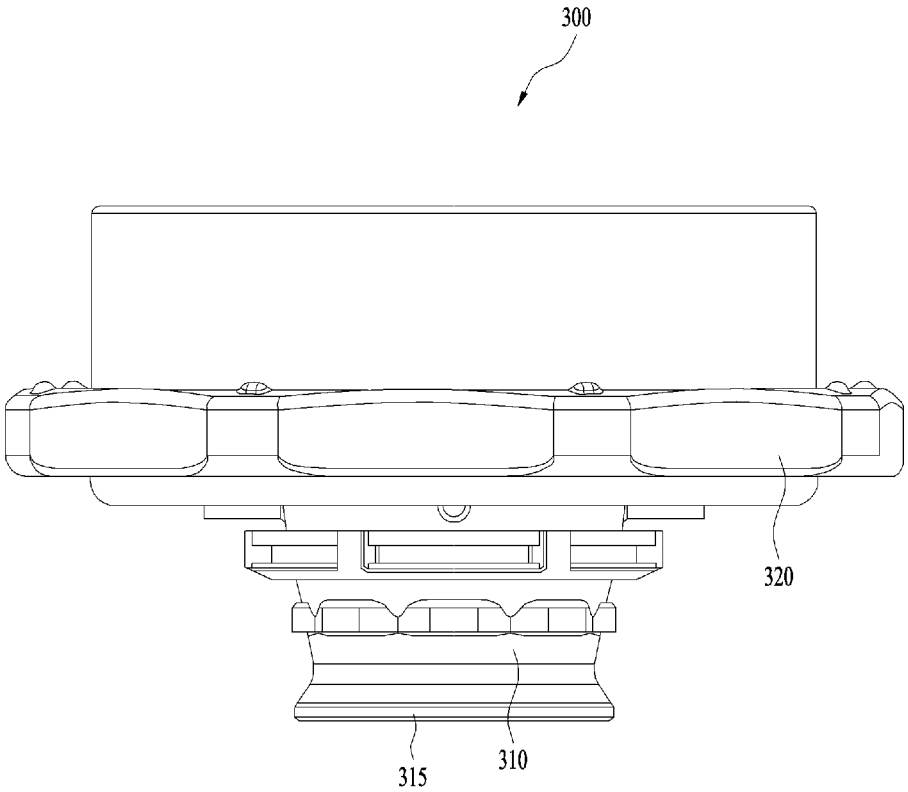
FIG. 4 is a side view illustrating an arm holder of FIG. 3.
Figure 5:
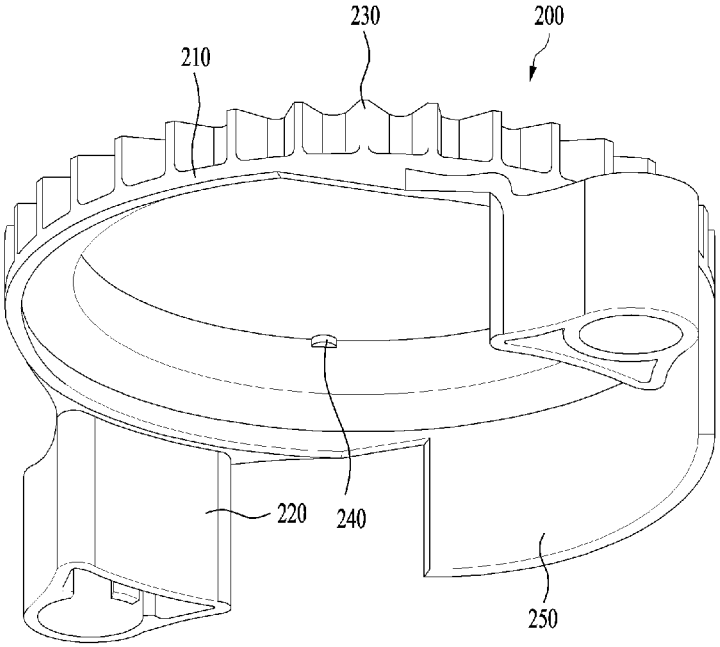
FIG. 5 is a view illustrating a fixed gear unit of FIG. 3.
Figure 6:
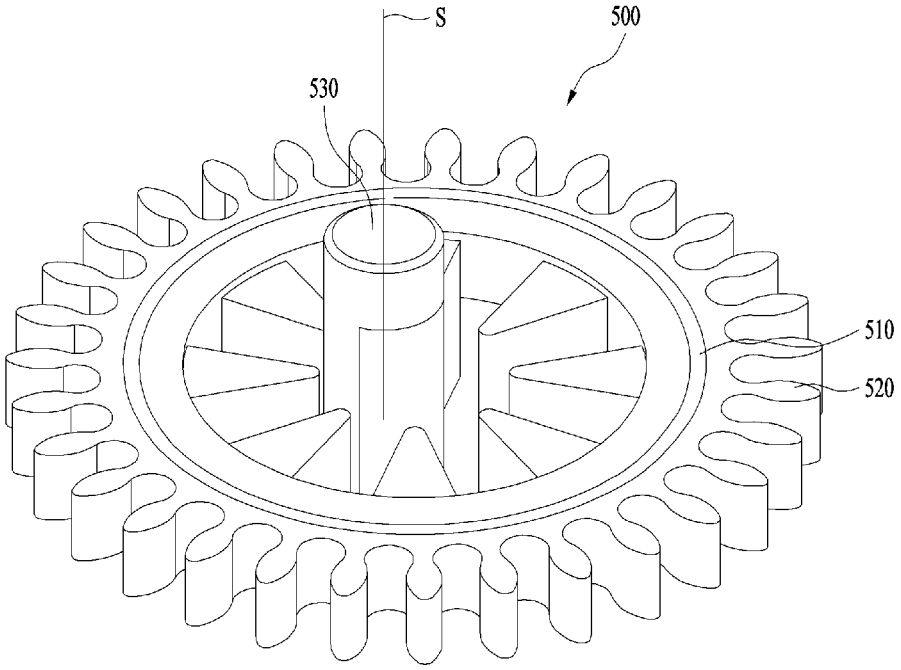
FIG. 6 is a perspective view illustrating an eccentric rotation unit of FIG. 3.
Figure 7:
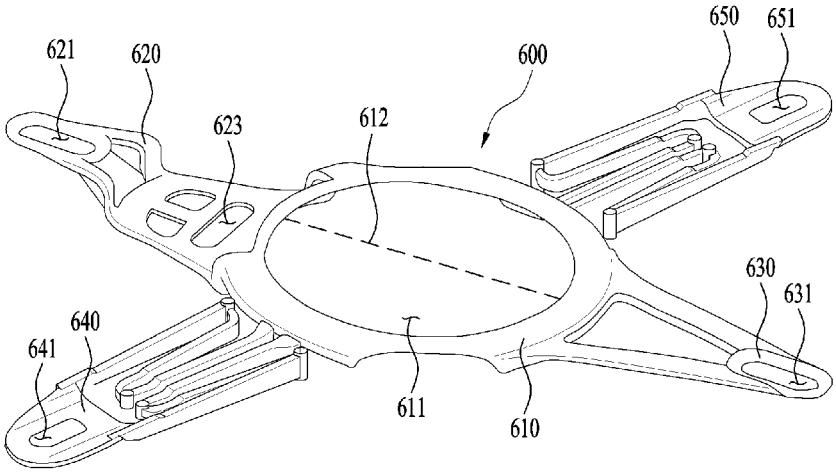
FIG. 7 is a perspective view illustrating a link member of FIG. 3.

FIG. 1 is a perspective view illustrating a dishwasher. FIG. 2 is a perspective view illustrating a sump and a spray arm assembly of FIG. 1. FIG. 3 is an exploded perspective view illustrating the spray arm assembly of FIG. 2. FIG. 4 is a side view illustrating an arm holder of FIG. 3. FIG. 5 is a view illustrating a fixed gear unit of FIG. 3. FIG. 6 is a perspective view illustrating an eccentric rotation unit of FIG. 3. FIG. 7 is a perspective view illustrating a link member of FIG. 3.

Referring to FIGS. 1 to 7, the dishwasher 1 according to the exemplary embodiments of the present invention includes a tub 2 defining a washing space 20, a door 3 configured to selectively open and close the washing space 20, a sump 4 provided inside the tub 2 to store wash water therein, at least one accommodating unit provided inside the tub 2 to accommodate a washing object therein, and a spray arm assembly 10 configured to spray wash water toward the washing object accommodated in the accommodating unit.

The tub 2 may define the external appearance of the dishwasher 1 and may also define therein the washing space 20, in which the washing object is accommodated. One side of the tub 2 may be opened, and the open side may be selectively opened and closed by the door 3.

The door 3 may selectively open and close the washing space 20, and may support the accommodating unit when the accommodating unit is unloaded. In addition, for example, a detergent box 31 and a rinsing-agent box 33 may be provided on the inner surface of the door 3.

The detergent box 31 and the rinsing-agent box 33 may store a detergent and a rinsing agent respectively, and may supply the same into the tub 2.

For example, the detergent may be supplied into the tub 2 in a washing operation, thereby increasing the effect of removing foreign substances. The rinsing agent may be supplied into the tub 2 and sprayed onto the washing object. In this case, the rinsing agent may assist in the sterilization and disinfection of the washing object. In addition, the rinsing agent may weaken the surface tension of water adhered on the surface of the washing object so as to allow the water to easily flow down, which may reduce the time taken for the washing object to dry. The structure of the detergent box 31 and the rinsing-agent box 33 will be described later with reference to FIGS. 9 to 11.

The sump 4 may receive and store water from outside via a water supply unit 7 and may circulate the water inside the dishwasher 1. Specifically, the water stored in the sump 4 may be sprayed toward the accommodating unit and the washing object via the spray arm assembly 10. The sprayed water may fall to the bottom of the washing space 20 and may pass through a sump cover 41 and a sump discharge portion 43 to thereby be recollected in the sump 4.

The accommodating unit may accommodate the washing object and may be provided in a number of at least one inside the tub 2. For example, the accommodating unit may include a first accommodating unit (not illustrated) and a second accommodating unit 6 provided above the first accommodating unit. The first accommodating unit and the second accommodating unit 6 may be unloaded outward through the opened side of the tub 2. The user may unload the respective accommodating units outward when putting the washing object thereinto or removing the washing object that has been completely washed.

At this time, the first accommodating unit may be unloaded outward along protrusions 23 and 24 formed on an inner sidewall 21 of the tub 2, and may move a door rail 30 formed on the inner surface of the door 3 after being removed from the tub 2.

The spray arm assembly 10 may be mounted on the sump cover 41, and may spray wash water toward the washing object accommodated in the accommodating unit.

In an embodiment, the spray arm assembly 10 may include a spray arm 100, which sprays wash water, a fixed gear unit 200 mounted on the sump cover 41 to rotatably support the spray arm 100, an arm holder 300 provided under the spray arm 100 and rotatably mounted on the sump cover 41, a flow-path switching unit 400 accommodated inside the arm holder 300 to switch the flow path of the wash water to be supplied to the spray arm 100, an eccentric rotation unit 500 rotatably mounted to the lower surface of the spray arm 100 and engaged with the fixed gear unit 200, and a link member 600 connected to each of the spray arm 100, the fixed gear unit 200, and the eccentric rotation unit 500.

The spray arm 100 may include a main arm 110 rotatably provided inside the tub 2, an auxiliary arm 130 separably mounted to the main arm 110, an extension 120 extending from the main arm 110 so as to be coupled to the auxiliary arm 120, and an arm holder coupling portion 140 in which at least a portion of the arm holder 300 is accommodated.

Meanwhile, although FIGS. 2 and 3 illustrate the spray arm 100 having two main arms 110 and two auxiliary arms 130, the present invention is not limited thereto. For example, the spray arm may include the main arm 100 and the auxiliary arm 130, each of which is provided in a number of three or more. Hereinafter, for convenience of description, only the case where the spray arm 100 includes two main arms 110 and two auxiliary arms 130 will be described.

The main arms 110 may receive wash water supplied from the sump 4 and spray the wash water toward the washing object. Although not illustrated, the main arms 110 may include multiple main flow paths therein, and may spray the wash water through spray holes 111 and 113 formed in the upper surface thereof. At this time, the wash water may be sprayed by water pressure generated in the main flow paths, without a separate power source.

Meanwhile, for example, the position, shape, and number of the spray holes 111 and 113 may be appropriately selected as needed. For example, when the position and shape of the spray holes 111 and 113 are combined in various ways, the direction in which the wash water is sprayed may be diversified. Accordingly, the area in which the wash water is sprayed may be increased, and the washing capability of the dishwasher 1 may be increased.

In an embodiment, the wash water may be sprayed in a direction that forms a predetermined angle relative to the direction perpendicular to the upper surface of the main arm 110. That is, the direction in which the wash water is sprayed from the spray holes 111 and 113 may not be the direction perpendicular to the upper surface of the main arm 110. In this case, the main arm 110 may be rotated by reaction force due to the spraying of wash water. That is, the main arm 110 may be rotated using only the spray pressure of wash water without a separate drive device, and the rotational direction and rotational speed of the main arm 110 may be determined by the spray direction and spray pressure of wash water.

One of the main arms 110 may be provided on the lower surface thereof with a gear rotating shaft 115, which is coupled to the eccentric rotation unit 500, and the respective main arms 110 may be provided on the lower surface thereof with guide bosses 116, which guide the movement of the link member 600. The gear rotating shaft 115 may serve as a rotating shaft of the eccentric rotation unit 500. The guide bosses 116 may be provided in the same number as the number of main arms 110 and may be coupled to coupling portions 641 and 651 of the link member 600. This will be described later.

The arm holder coupling portion 140 may be provided on the lower surface of the main arms 110 and may accommodate at least a portion of the arm holder 300.

The extensions 120 may extend from the main arms 110 in radial directions so as to be coupled to the auxiliary arm 130. Thus, the extensions 120 may be provided in the same number as the number of auxiliary arms 130. Although not illustrated, transfer flow paths, which are connected to the main flow paths in the main arm 110, may be formed in the extensions 120. The wash water supplied from the sump 4 may sequentially pass through the main flow paths and the transfer flow path to thereby be supplied to the auxiliary arms 130.

The auxiliary arms 130 may be separably mounted to the respective extensions 120, and may have multiple spray holes 131 and 133 formed in the upper surface thereof for spraying the wash water. In addition, although not illustrated, auxiliary flow paths, through which the wash water passes, may be provided in the auxiliary arms 130. The wash water supplied from the sump 4 may sequentially pass through the main flow paths, the transfer flow paths, the auxiliary flow paths, and the spray holes 131 and 133 to thereby be sprayed toward the washing object.

In this case, for example, the position, shape, and number of the spray holes 131 and 133 may be appropriately selected as needed. For example, when the position and shape of the spray holes 131 and 133 are combined in various ways, the direction in which the wash water is sprayed may be diversified. Accordingly, the area in which the wash water is sprayed may be increased, and the washing capability of the dishwasher 1 may be increased.

In an exemplary embodiment, each auxiliary arm 130 may have a discharge hole 135 formed in the outer circumferential surface thereof for discharging foreign substances.

When foreign substances are introduced into the auxiliary arms 130, the spray holes 131 and 133 in the auxiliary arms 130 may become clogged, or the auxiliary arms 130 may not smoothly perform rolling. Since this directly causes deterioration in the washing capability of the dishwasher, it is necessary to remove the foreign substances. The discharge hole 135 is formed so as to be close to the main arm 110, thereby enabling the removal of foreign substances introduced into the auxiliary arm 130. In particular, when the discharge hole 135 is provided in the side surface or the lower surface of the auxiliary arm 130, the foreign substances may be more easily discharged outward.

In an embodiment, the auxiliary arm 130 may be manufactured using a material different from that of the main arm 110. This serves to increase the strength of the auxiliary arm 130, which continuously performs rotational reciprocating motion, so as to prevent abrasion thereof. For example, the main arm may be formed using a synthetic resin, and the auxiliary arm may be formed using, for example, aluminum or stainless steel. In this case, the aesthetics of the spray arm 100 may be improved.

As exemplarily illustrated in FIG. 4, the arm holder 300 may include an inlet portion 310 rotatably coupled to the sump cover 41, a separation preventing portion 315, which prevents the arm holder 300 from being separated from the sump cover 41, and a coupling portion 320 coupled to the spray arm 100.

The arm holder 300 may rotate along with the spray arm 100 on the sump cover 41. In addition, the wash water supplied from the sump 4 may be supplied to the spray arm 100 after passing through the inside of the arm holder 300.

Meanwhile, the flow path switching unit 400 may be accommodated inside the arm holder 300. The flow path switching unit 400 may move upward when the wash water is introduced into the arm holder 300, and may move downward when the introduction of wash water stops. Through the movement of the flow path switching unit 400, the direction in which the wash water is supplied to the spray arm 100 may be varied.

The fixed gear unit 200 may be mounted on the top of the sump cover 41 so as to surround the outer circumferential surface of the arm holder coupling portion 140. At this time, the fixed gear unit 200 is fixed to the sump cover 41 via a fastening member, and thus may not rotate.

As illustrated in FIG. 5, the fixed gear unit 200 may include a rim portion 210 provided with multiple first gear teeth 230 and a support portion 220 extending downward from the rim portion 210 so as to be fixed on the sump cover 41.

The rim portion 210 may have a hollow ring shape so that the arm holder coupling portion 140 is accommodated in the hollow rim portion 210. At this time, at least one gap-reduction boss 240 may be provided on the inner circumferential surface of the rim portion 210 in order to reduce a gap between the rim portion 210 and the arm holder coupling portion 140.

In an embodiment, the fixed gear unit 200 may further include a hand-jam-preventing portion 250 extending downward from the rim portion 210.

As illustrated in FIG. 2, a filter unit 700 may be installed to the sump cover 41 in order to filter foreign substances. The filter unit 700 may be unloaded upward through the space between the main arm 110 and the auxiliary arm 130. At this time, there is the possibility of an accident in which a user's hand is jammed inside the fixed gear unit 200. The hand-jam-preventing portion 250 may prevent the user's hand from being jammed inside a drive unit such as, for example, the fixed gear unit 200 while replacing the filter unit 700, thereby reducing the possibility of the accident. In addition, the hand-jam-preventing portion 250 may prevent foreign substances removed from the washing object from being introduced into the drive unit.

The eccentric rotation unit 500 may be rotatably mounted on the lower surface of the spray arm 100 and may be engaged with the first gear teeth 230 of the fixed gear unit 200.

The eccentric rotation unit 500 may include a rim portion 510 coupled to the gear rotating shaft 115 on the lower surface of the main arm 110, multiple second gear teeth 520 formed on the outer circumferential surface of the rim portion 510, and an eccentric boss 530 protruding from the rim portion 510.

The eccentric rotation unit 500 may rotate when the main arm 110 rotates since the rim portion 510 is rotatably coupled to the gear rotating shaft 115. In addition, the eccentric rotation unit 500 may circularly move along the periphery of the fixed gear unit 200 since the second gear teeth 520 on the outer circumferential surface of the rim portion 510 are engaged with the first gear teeth 230 of the fixed gear unit 200. That is, when the main arm 110 rotates, the eccentric rotation unit 500 may spin in place while circularly moving along the periphery of the fixed gear unit 200.

In an embodiment, the number of first gear teeth 230 and the number of second gear teeth 520 may be coprime integers.

When the number of first gear teeth 230 and the number of second gear teeth 520 are multiples, the contact region of the first gear teeth 230 and the second gear teeth 520 is always constant, and therefore, there is the possibility of friction between the gear teeth 230 and 520 worsening. In addition, the rotation angle of the auxiliary arm 130 is always constant regardless of the rotational position of the main arm 110, and therefore there is the possibility of wash water having a constant spray pattern. When the spray pattern of wash water is constant, the range within which the wash water is sprayed is consequently limited, which may cause deterioration in the washing capability of the dishwasher 1.

Accordingly, when the number of first gear teeth 230 and the number of second gear teeth 520 are coprime integers, the friction between the gear teeth 230 and 520 may be reduced and the spray pattern of the wash water may be further diversified.

The link member 600 may include a rim portion 610 having an insertion hole 611 and multiple extensions 620, 630, 640 and 650 extending from the rim portion 610 in radial directions.

The link member 600 may be connected to both the spray arm 100 and the eccentric rotation unit 500. Specifically, the arm holder coupling portion 140 of the spray arm 100 may be inserted into the insertion hole 611, and the extensions 620, 630, 640 and 650 may be respectively coupled to the main arms 110 and the auxiliary arms 130. Guide portions 621 and 631 of the first and second extensions 620 and 630 may be respectively coupled to the guide bosses 116 of the main arms 110, and the coupling portions 641 and 651 of the third and fourth extensions 640 and 650 may be respectively coupled to power transmission portions 136 of the auxiliary arms 130. At this time, the first extension 620 may further have an insertion portion 623, into which the eccentric boss 530 of the eccentric rotation unit 500 is inserted. The insertion portion 623 may extend in the direction substantially perpendicular to the direction in which the first extension 620 extends.

The torque of the eccentric rotation unit 500 may be converted into the rectilinear reciprocating motion of the link member 600, and the link member 600 may cause the auxiliary arm 130 to perform rolling. At this time, the expression "the auxiliary arm 130 performs rolling" means that the auxiliary arm 130 performs rotational reciprocating motion within a predetermined angular range about a rotation axis corresponding to the direction in which the auxiliary arm 130 extends. In this case, the angle at which wash water is sprayed by the auxiliary arm 130 may continuously vary, and the spray range of wash water may be diversified. Thereby, the washing capability of the dishwasher 1 may be increased.

Hereinafter, the rolling of the auxiliary arm 130 will be described in more detail with reference to FIGS. 8(*a*) to 8(*d*).

Figure 8:
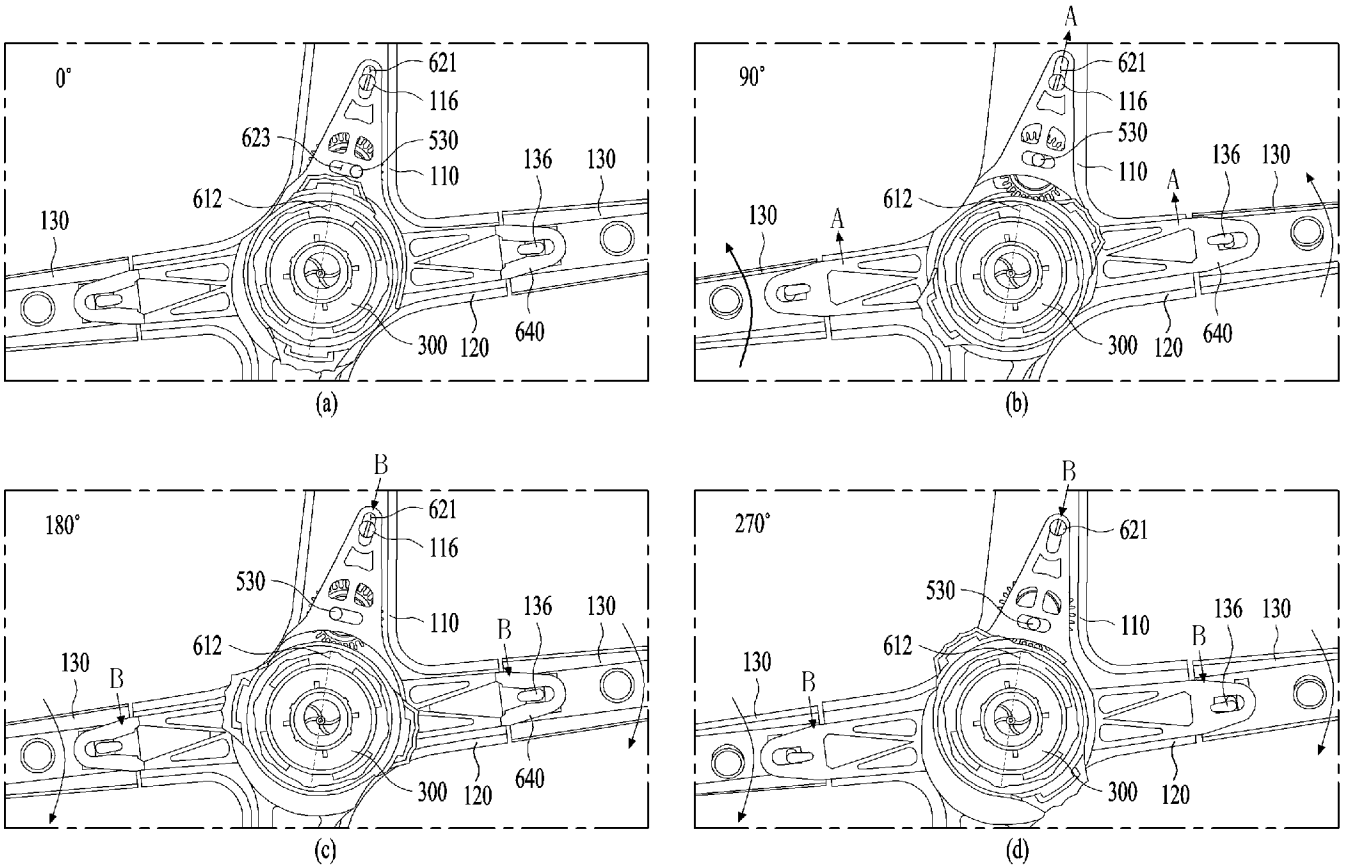
FIGS. 8(*a*) to 8(*d*) are views illustrating the procedure of rolling an auxiliary arm by the link member.

FIGS. 8(*a*) to 8(*d*) are views illustrating the process of rolling the auxiliary arm by the link member 600. FIGS. 8(*a*) to 8(*d*) illustrate the lower surface of the spray arm assembly 10 when the eccentric rotation unit 500 rotates by 0°, 90°, 180° and 270° respectively.

First, referring to FIG. 8(*a*), in the initial state in which the eccentric rotation unit 500 does not rotate, the eccentric boss 530 is located in one side of the insertion portion 623 and the auxiliary arm 130 is oriented parallel to the main arm 110.

FIG. 8(*b*) illustrates the state in which the main arm 110 rotates by 90° clockwise. When the main arm 110 rotates clockwise, the eccentric rotation unit 500 engaged with the fixed gear unit 200 rotates counterclockwise. Thereby, the eccentric boss 530 of the eccentric rotation unit 500 applies pressure to the link member 600 in the direction A of the major axis 612. At this time, since the guide boss 116 is movable in the direction A within the guide portion 621, the link member 600 moves in the direction indicated by the arrow A.

Through the movement of the link member 600, the power transmission portions 136 of the auxiliary arms 130 connected to the third and fourth extensions 640 and 650 may receive force in the direction A, and the auxiliary arms 130 may rotate clockwise by a predetermined angle.

As illustrated in FIG. 8(*c*), when the main arm 110 continuously rotates clockwise and the rotation angle thereof becomes 180° relative to the initial state (FIG. 8(*a*)), the eccentric rotation unit 500 rotates counterclockwise by 180° relative to the initial state (FIG. 8(*a*)).

In this case, the eccentric boss 530 may apply pressure to the link member 600 in the direction B of the major axis 612, and the link member 600 may move in the direction B to thereby return to the position illustrated in FIG. 8(*a*). At this time, since the power transmission portion 136 of the auxiliary arm 130 may receive force in the direction B, the auxiliary arm 130 may rotate counterclockwise by a predetermined angle to thereby return to the initial position illustrated in FIG. 8(*a*).

As illustrated in FIG. 8(*d*), when the main arm 110 continuously rotates clockwise and the rotation angle thereof reaches 270° relative to the initial state (FIG. 8(*a*)), the eccentric rotation unit 500 rotates counterclockwise by 270° relative to the initial state (FIG. 8(*a*)).

In this case, the eccentric boss 530 may apply pressure to the link member 600 in the direction B of the major axis 612, and the link member 600 may move in the direction B. Thereby, the power transmission portion 136 of the auxiliary arm 130 may receive force in the direction B, and the auxiliary arm 130 may rotate counterclockwise by a predetermined angle.

Thereafter, when the main arm 110 rotates further clockwise, the link member 600 may again move in the direction A to thereby return to the state illustrated in FIG. 8(*a*). At this time, the auxiliary arm 130 rotates clockwise to thereby return to the position illustrated in FIG. 8(*a*).

As described above, the eccentric rotation unit 500 may convert the rotation of the main arm 110 into the rectilinear reciprocating motion of the link member 600, and the auxiliary arm 130 connected to the link member 600 may perform rotational reciprocating motion (rolling) within a predetermined angular range about the rotation axis corresponding to the direction in which the auxiliary arm 130 extends.

Figure 9:
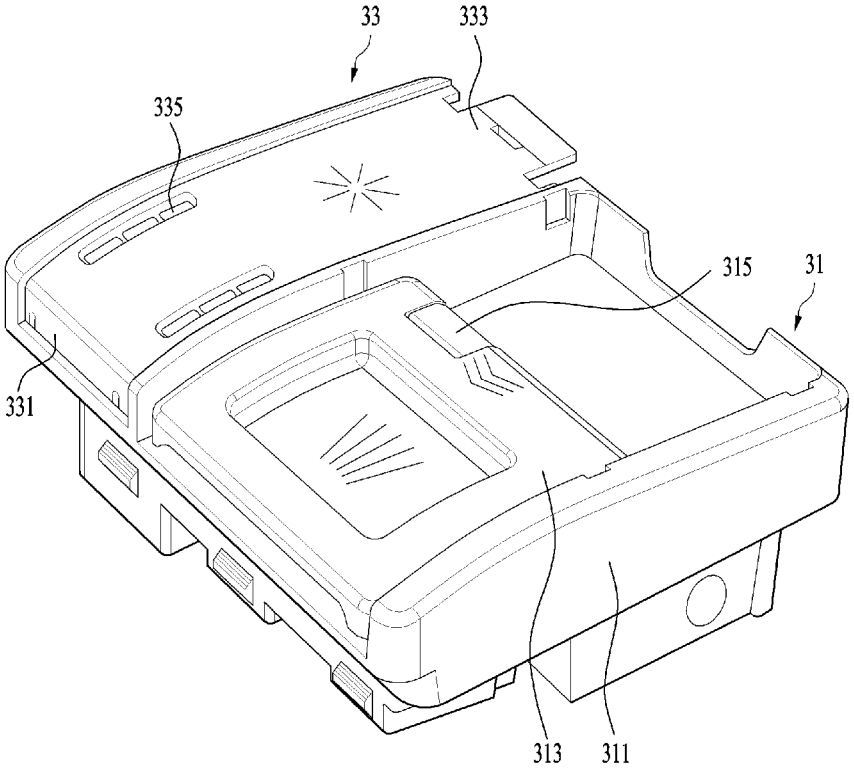
FIG. 9 is a perspective view illustrating a detergent box and a rinsing-agent box of FIG. 1.
Figure 10:
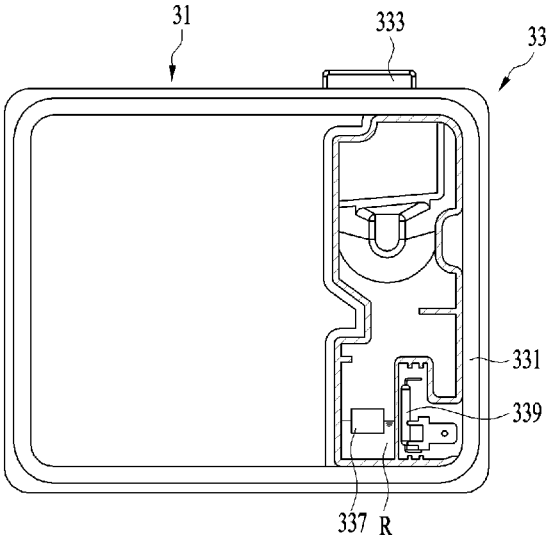
FIGS. 10 and 11 are cross-sectional views illustrating the inside of the rinsing-agent box.
Figure 11:
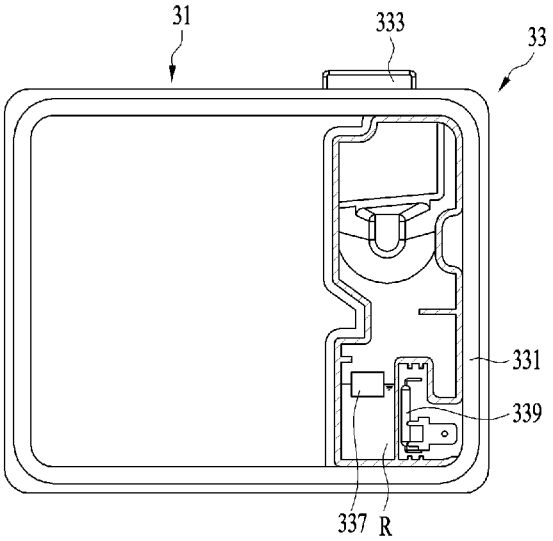

FIG. 9 is a perspective view illustrating the detergent box and the rinsing-agent box of FIG. 1. FIGS. 10 and 11 are cross-sectional views illustrating the inside of the rinsing-agent box.

Referring to FIG. 9, the detergent box 31 may include a detergent box body 311 forming a chamber (not illustrated) in which a detergent is accommodated, a detergent box cover 313 configured to selectively open and close the chamber, and an opening piece 315 used to manually open the detergent box cover 313. In addition, the detergent box body 311 may be provided on the rear surface thereof with an opening/closing unit, which enables the detergent box cover 313 to be automatically opened or closed according to a selected course.

When the door 3 is opened, the detergent box cover 313 is oriented to face upward. When the opening piece 315 is pushed in this state, the detergent box cover 313 slides, causing the chamber to be exposed outward so that a detergent may be introduced into the chamber. The chamber may again be closed when the user slides the detergent box cover 313 to the original position thereof after the detergent is introduced.

Thereafter, washing may be performed according to a selected course. The opening/closing unit enables the detergent box cover 313 to be automatically opened or closed.

The rinsing-agent box 33 may include a rinsing-agent box body 331 in which a rinsing agent is accommodated, a rinsing-agent box cover 333 rotatably connected to the rinsing-agent box body 331 so as to selectively open and close the rinsing-agent box body 331, and multiple rinsing-agent discharge holes 335 formed in the rinsing-agent box cover 333. The user may open the rinsing-agent box cover 333 in order to put the rinsing agent into the rinsing-agent box body 331, and the rinsing agent may be supplied to the washing space 20 through the rinsing-agent discharge holes 335.

Meanwhile, although FIG. 9 illustrates the rinsing-agent box cover 333 as being rotatably connected to the rinsing-agent box body 331, the present invention is not limited thereto. For example, the rinsing-agent box cover 333 may also be configured to slide, like the detergent box cover 313.

FIGS. 10 and 11 are rear cross-sectional views of the rinsing-agent box 33.

Referring to FIGS. 10 and 11, a water-level sensing unit may be provided inside the rinsing-agent box 33 in order to sense whether or not the amount of rinsing agent is insufficient. For example, the water-level sensing unit may include a permanent magnet 337, which may float on the rinsing agent R, and a reed switch 339, which senses variation in magnetic force.

The reed switch 339 may be fixed to the rinsing-agent box body 331, and the permanent magnet 338 may float on the rinsing agent R. That is, the height of the permanent magnet 337 may vary according to the amount of rinsing agent R. The permanent magnet 337 may move down when the amount of rinsing agent R is small (see FIG. 10), and may move up when the amount of rinsing agent R is increased (see FIG. 11).

As the permanent magnet 337 moves up or down, the distance between the permanent magnet 337 and the reed switch 339 varies, and the magnetic force applied to the reed switch 339 varies. The reed switch 339 may sense whether or not the amount of rinsing agent R is insufficient based on such variation in magnetic force.

Specifically, as illustrated in FIG. 10, when the amount of rinsing agent R is small, the permanent magnet 337 may move down, and the distance between the permanent magnet 337 and the reed switch 339 may be reduced. In this case, the magnetic force applied to the reed switch 339 is increased. When the magnetic force reaches a predetermined value, the reed switch 339 may be turned on, thus enabling a determination that the amount of rinsing agent is insufficient.

Conversely, as illustrated in FIG. 11, when the amount of rinsing agent R is large, the permanent magnet 337 may move up, and the distance between the permanent magnet 337 and the reed switch 339 may be increased. In this case, the magnetic force applied to the reed switch 339 is reduced. When the magnetic force is less than the predetermined value, the reed switch 339 may be turned off, thus enabling a determination that the amount of rinsing agent is sufficient.

Hereinafter, a method of controlling the dishwasher 1 of FIG. 1 will be described with reference to FIG. 12. Meanwhile, although FIG. 1 illustrates the dishwasher 1 in which the spray arm assembly 10 includes not only the main arms 110, but also the auxiliary arms 130, the present invention is not limited thereto. That is, the method of controlling the dishwasher according to the present invention may be applied to all types of dishwashers that use a rinsing agent regardless of the shape of the spray arm.

Figure 12:
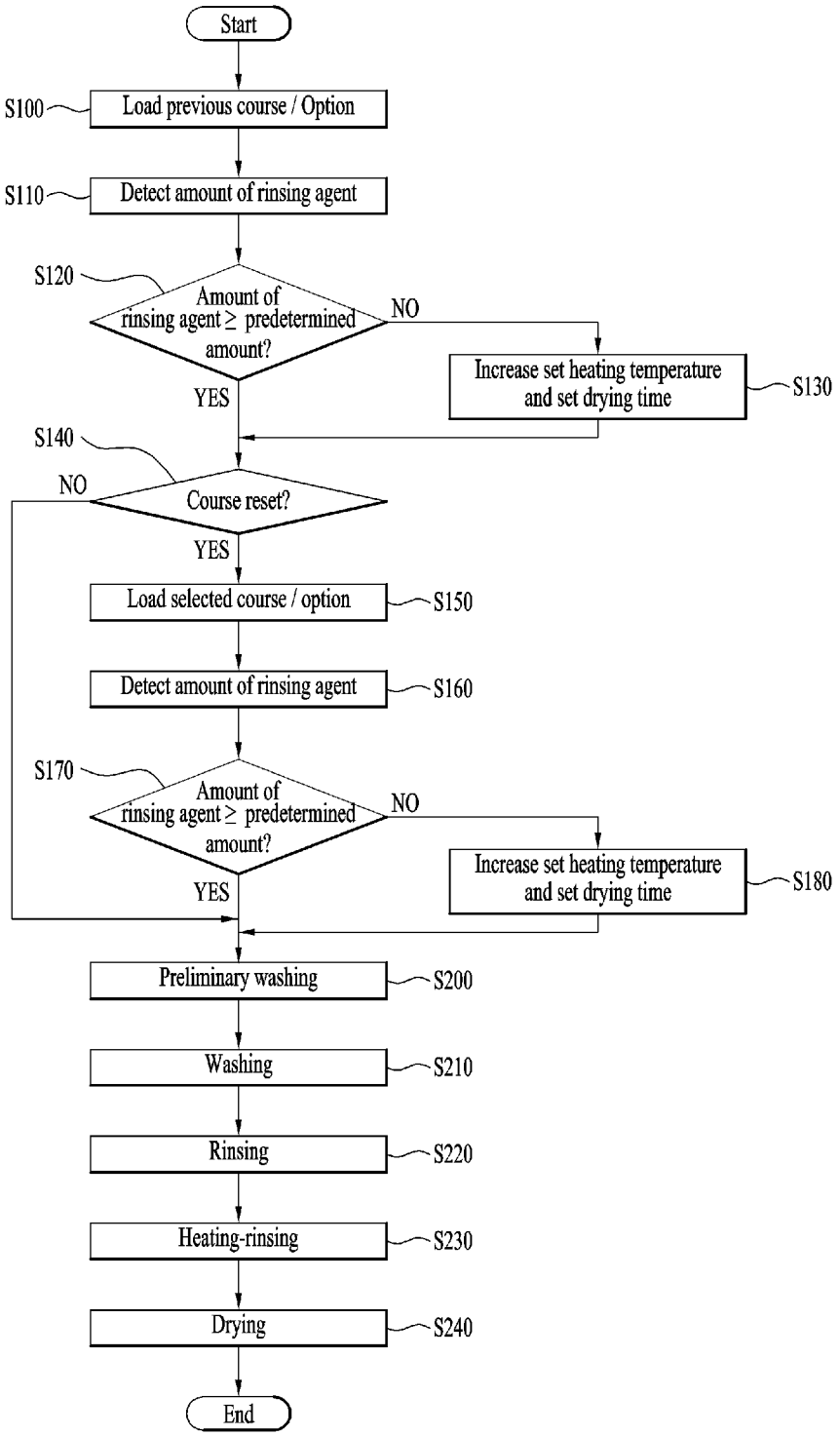
FIG. 12 is a flowchart for explaining a method of controlling the dishwasher of FIG. 1 according to the amount of rinsing agent.

FIG. 12 is a flowchart for explaining a method of controlling the dishwasher of FIG. 1 according to the amount of rinsing agent.

First, when a voltage is applied to the dishwasher 1, a course that is previously performed and/or an option thereof is loaded (S100).

Here, the course may be a combination of processes including at least one of multiple processes such as, for example, a preliminary washing process S200, a washing process S210, a rinsing process S220, a heating-rinsing process S230, and a drying process S240. For example, a first course including only a washing process and a rinsing process, or a second course including all of the aforementioned processes, namely the preliminary washing, washing, rinsing, heating-rinsing, and drying processes, may be introduced.

The preliminary washing process may be the process of keeping the washing object accommodated inside the tub 2 in water by spraying the water on the washing object, in order to allow contaminants adhered to the washing object to be easily removed.

The washing process may be the process of removing the contaminants adhered to the washing object by spraying water and a detergent on the washing object.

The rinsing process may be the process of removing the contaminants and detergent remaining on the washing object by spraying water on the washing object. At this time, a rinsing agent may be sprayed along with the water. The rinsing agent may assist in the sterilization and disinfection of the washing object. In addition, the rinsing agent may weaken the surface tension of water adhered on the surface of the washing object so as to allow the water to easily flow down, which may reduce the time taken for the washing object to dry.

The heating-rinsing process may be the process of spraying water, which is heated to a predetermined temperature, onto the washing object. This process may reduce the time taken for the washing object to be heated and dried, and may realize the sterilization and disinfection of the washing object.

The drying process may be the process of removing moisture from the surface of the washing object. In this case, the washing object may be subjected to natural drying, or a drying fan (not illustrated) may be operated to discharge the air inside the tub 2 to the outside, which may reduce the drying time.

Meanwhile, options may be used to set the operating conditions for each process with respect to the selected course. For example, the operating conditions may be information regarding, for example, the temperature of the water to be supplied to the washing object in the heating-rinsing process, the operating time of the drying fan in the drying process, and the number of repetitions of each process.

When the dishwasher 1 is turned on, the most recent course and option information thereof may be loaded. Alternatively, the most frequent course during a predetermined duration and option information thereof may be loaded. This may be set in various ways according to the user selection.

Subsequently, the amount of rinsing agent stored in the rinsing-agent box 33 is measured (S110), and it is determined whether or not the measured amount of the rinsing agent is a predetermined amount or more (S120).

For example, as described above with reference to FIGS. 9 to 11, the amount of rinsing agent may be measured using the permanent magnet 337 and the reed switch 339.

When the detected amount of the rinsing agent is less than the predetermined amount, the operating condition of each process is reset. For example, at least one of the temperature of the water to be supplied in the heating-rinsing process and the drying time in the drying process is increased (S130).

In this case, the predetermined amount of the rinsing agent may be the minimum amount of the rinsing agent that needs to be supplied to the washing object under a selected course and/or option. This may be set during the manufacture of the dishwasher 1, or may be set by the user.

When the detected amount of the rinsing agent is less than the predetermined amount, the rinsing agent may not be supplied to the washing object in the rinsing process. Since the rinsing agent serves to reduce the drying time, the washing object may not be completely dried when no rinsing agent is supplied. Therefore, when the amount of rinsing agent is insufficient, a control operation may be performed to automatically increase the set heating temperature in the heating-rinsing process or to automatically increase the drying time in the drying process so as to completely dry the washing object.

In an exemplary embodiment, the operation of increasing the drying time may include increasing the operating time of the drying fan.

Since the drying fan discharges the air inside the tub 2 to the outside, the washing object may be more rapidly dried when the operating time of the drying fan is increased. Thereby, the washing object may be completely dried even if no rinsing agent is used.

Meanwhile, the operation of increasing the heating temperature and the operation of increasing the drying time may be selectively performed, or may be performed at the same time.

For example, when the detected amount of the rinsing agent is less than the predetermined amount of the rinsing agent, the set heating temperature in the heating-rinsing process may be increased to 75° C. and the operating time of the drying fan may be increased by 20 minutes. However, the degree of increasing the heating temperature and the drying time may be set in various ways as needed.

Alternatively, the dishwasher 1 may be used at night during which the user is sleeping. In this case, a sufficient time may be allotted for the drying process. Thus, by increasing the interval between the on-time and the off-time of the drying fan, the washing object may be completely dried even if no rinsing agent is used.

For example, the overall operating time of the drying fan may be increased to 8.5 hours or more by increasing the interval between the on-time and the off-time of the drying fan.

Meanwhile, the user may select a course that is different from a previous course and/or an option thereof (S140). In this case, the operating conditions of the selected course and/or the option thereof may be loaded (S150), and it is determined whether or not the current amount of the rinsing agent stored in the rinsing-agent box 33 is sufficient to meet the requirement of the operating conditions. At this time, the operating conditions of the dishwasher with respect to the selected course and the option thereof may be different from the initially loaded operating condition (S100). Thus, whether or not to supply the rinsing agent is determined one more time.

Specifically, the current amount of the rinsing agent is detected (S160), and the detected amount of the rinsing agent is compared with the amount of rinsing agent required under the selected operating conditions (S170).

When the detected amount of the rinsing agent is less than the amount of rinsing agent required under the selected operating conditions, the operating conditions for each process are reset. For example, at least one of the temperature of the water to be supplied in the heating-rinsing process and the drying time in the drying process is increased (S180). This may be performed in substantially the same manner as the method described in the operation S130. Thereby, the operating conditions may be set so as to completely dry the washing object even if no rinsing agent is used.

Thereafter, at least one process among the preliminary washing process S200, the washing process S210, the rinsing process S220, the heating-rinsing process S230 and the drying process S240 is performed according to the set course and the option thereof.

As described above, according to the exemplary embodiments of the present invention, the method of controlling the dishwasher may automatically reset the operating conditions for each process according to the amount of rinsing agent. Thereby, the complete drying of a washing object may be realized even if no rinsing agent is used.

Although the exemplary embodiments have been illustrated and described as above, it will of course be apparent to those skilled in the art that the embodiments are provided to assist in understanding of the present invention and the present invention is not limited to the above described particular embodiments, and various modifications and variations can be made in the present invention without departing from the spirit or scope of the present invention, and such modifications and variations should not be understood individually from the viewpoint or scope of the present invention.

What is claimed is:

1. A method of controlling a dishwasher, the method comprising:

loading a first course that has been previously performed and an option corresponding to the first course;

detecting a first amount of a rinsing agent stored in a rinsing-agent box of the dishwasher;

determining whether or not the detected first amount of the rinsing agent stored in the rinsing-agent box is a predetermined amount or more;

washing an object accommodated inside a tub by spraying water and detergent onto the object;

rinsing the object by spraying water onto the object; and drying the object by removing moisture adhered to the object, wherein the method further comprises:

increasing at least one of a temperature of water to be supplied in the rinsing or a drying time in the drying based on the detected first amount of the rinsing agent stored in the rinsing-agent box being less than the predetermined amount, and wherein the method further comprises operations performed before the rinsing and the drying based on a user selecting a second course that is different from the first course, the operations comprising:

loading operating conditions and an option corresponding to the second course, based on loading the operating conditions, detecting a second amount of the rinsing agent stored in the rinsing-agent box, comparing the detected second amount of the rinsing agent stored in the rinsing-agent box to an amount of rinsing agent corresponding to the selected operating conditions, and increasing at least one of the temperature of water to be supplied in the rinsing or the drying time in the drying based on the detected second amount of the rinsing agent being less than the amount of rinsing agent corresponding to the selected operating conditions.

2. The method according to claim 1, wherein rinsing includes heating water to a predetermined temperature and spraying the heated water onto the object, and wherein increasing the temperature of the water to be supplied in the rinsing includes increasing the predetermined temperature used in heating water.

3. The method according to claim 1, wherein drying includes operating a drying fan to thereby discharge air from an inside of the tub to an outside, and wherein increasing the drying time includes increasing an operating time of the drying fan.

4. The method according to claim 3, wherein increasing the operating time of the drying fan includes increasing an interval between an on-time and an off-time of the drying fan.

5. The method according to claim 1, wherein rinsing includes spraying the rinsing agent onto the object based on determining that the detected second amount of the rinsing agent is the predetermined amount or more.

6. The method according to claim 1, further comprising:

automatically resetting at least one of the loaded operating conditions based on determining that the detected second amount of the rinsing agent is less than the predetermined amount.

7. The method according to claim 6, wherein the operating conditions include the temperature of water to be supplied in the rinsing and the drying time for the drying.

8. The method according to claim 7, wherein automatically resetting includes increasing the temperature of the water to be supplied in the rinsing.

9. The method according to claim 7, wherein automatically resetting includes increasing an operating time of a drying fan in the drying.

10. The method according to claim 1, wherein detecting includes detecting existence of the rinsing agent.

11. The method of claim 1, wherein the operating conditions are loaded based on the user selecting the second course in a state in which the detected first amount of the rinsing agent stored in the rinsing-agent box is less than the predetermined amount.

12. The method according to claim 1, further comprising:

preliminary-washing the object accommodated inside the tub by spraying water onto the object.

13. The method according to claim 12, wherein determining that the detected second amount of the rinsing agent is less than the predetermined amount is performed before the preliminary-washing.

14. The method according to claim 12, wherein increasing at least one of the temperature of the water to be supplied in the rinsing or the drying time in the drying comprises increasing the temperature of the water to be supplied in the rinsing.

15. The method according to claim 12, wherein increasing at least one of the temperature of the water to be supplied in the rinsing or the drying time in the drying comprises increasing the drying time in the drying.

16. The method according to claim 15, wherein increasing the drying time in the drying includes increasing an operating time of a drying fan.

17. The method according to claim 16, wherein increasing the operating time of the drying fan includes increasing an interval between an on-time and an off-time of the drying fan.

18. The method according to claim 12, wherein increasing at least one of the temperature of the water to be supplied in the rinsing or the drying time in the drying comprises increasing the temperature of the water to be supplied in the rinsing and the drying time in the drying.

19. The method according to claim 12, wherein detecting the second amount of the rinsing agent stored in the rinsing-agent box includes detecting existence of the rinsing agent in the rinsing-agent box.

20. The method according to claim 12, wherein rinsing includes spraying the rinsing agent onto the object based on determining that the detected second amount of the rinsing agent is the predetermined amount or more.

* * * * *